US012018865B2

(12) United States Patent
Lucich

(10) Patent No.: US 12,018,865 B2
(45) Date of Patent: Jun. 25, 2024

(54) INSULATION AND COOLING SYSTEM FOR TEMPERATURE SENSITIVE MATERIALS

(71) Applicant: Insu Health Design, Inc., San Juan, PR (US)

(72) Inventor: Mason Anthony Lucich, Houston, TX (US)

( * ) Notice: Subject to any disclaimer, the term of this patent is extended or adjusted under 35 U.S.C. 154(b) by 0 days.

(21) Appl. No.: 17/374,099

(22) Filed: Jul. 13, 2021

(65) Prior Publication Data

US 2021/0389027 A1 Dec. 16, 2021

Related U.S. Application Data

(60) Provisional application No. 63/037,215, filed on Jun. 10, 2020.

(51) Int. Cl.
*F25B 21/02* (2006.01)

(52) U.S. Cl.
CPC ..... *F25B 21/02* (2013.01); *F25B 2321/023* (2013.01); *F25B 2321/0251* (2013.01)

(58) Field of Classification Search
CPC ..... F25B 2321/023; F25B 2321/0251; F25B 21/02
See application file for complete search history.

(56) References Cited

U.S. PATENT DOCUMENTS

| | | | | |
|---|---|---|---|---|
| 6,401,461 | B1 * | 6/2002 | Harrison | F25B 21/02 62/3.61 |
| 7,445,379 | B2 * | 11/2008 | Chang | G01N 25/20 374/142 |
| 9,334,837 | B2 * | 5/2016 | Chung | H10N 10/00 |
| 9,462,897 | B2 * | 10/2016 | Nuttall | F24H 9/1863 |
| 10,495,356 | B2 * | 12/2019 | Ye | A45F 3/04 |
| 2002/0121095 | A1 * | 9/2002 | Adamski | F25D 19/00 62/3.6 |
| 2009/0100843 | A1 * | 4/2009 | Wilkinson | F25B 21/02 62/3.7 |
| 2011/0247356 | A1 * | 10/2011 | Krosse | F25B 27/002 62/457.1 |
| 2014/0158429 | A1 * | 6/2014 | Kader | E21B 47/0175 175/40 |
| 2015/0075185 | A1 * | 3/2015 | Sims | F28F 1/00 62/3.5 |
| 2017/0056289 | A1 * | 3/2017 | Tsuno | F25B 21/04 |
| 2017/0122650 | A1 * | 5/2017 | Hiemeyer | F25B 21/02 |

* cited by examiner

*Primary Examiner* — Filip Zec
(74) *Attorney, Agent, or Firm* — Eugenio J. Torres-Oyola; Victor M. Rodriguez-Reyes; Rafael Rodriguez-Muriel

(57) ABSTRACT

An insulation and cooling system for temperature sensitive materials is disclosed. The system removes the risk of heat back-flow from the powered down cooler to the cooled volume, and in doing so increases the potential battery life of the device and removes the risk of the contents rapidly heating when the cooler loses power.

11 Claims, 11 Drawing Sheets

Parameters Monitoring & Alert Notifications Process Flowchart:

INSULATION AND COOLING SYSTEM FOR TEMPERATURE SENSITIVE MATERIALS

STATEMENT REGARDING FEDERALLY SPONSORED RESEARCH AND DEVELOPMENT

N/A

RELATED APPLICATIONS

This application claims priority from U.S. Provisional Application 63/037,215, filed on Jun. 20, 2020, which the contents of which are fully incorporated by reference.

BACKGROUND OF THE INVENTION

Field of the Invention

The present invention is generally directed to a storage system for sensitive materials that require temperature control. More specifically, the present invention comprises a highly-insulated volume in which to store the materials, that works by separating the cooling unit from said volume with a cooling loop, reducing the run-time of the cooling unit and preventing latent heat within the cooling unit from heating the cooled volume when the system is powered off.

Discussion of the Background

Temperature-sensitive medications, bio-components, and many other expensive materials require cold storage, otherwise they risk spoiling. With current consumer-facing portable devices used to store these expensive materials, battery life is relatively short (4-8 hours) and when their batteries die, the latent heat within the cooling system heats the stored materials very quickly. This drastically increases the risk of spoiling. There is currently no small, portable cooling and storage solution with a long battery life to protect these materials.

Current battery-powered devices on the market used to store temperature-sensitive medications and bio-components utilize thermoelectric (Peltier) coolers (often described as heat pumps) to remove heat from the volume where the medicine or components are stored. These coolers have a hot side and a cold side, and when powered on, the average temperature across these coolers is much higher than ambient. When they are powered off that heat flows into the volume where these sensitive and expensive materials are stored. This means the coolers must be run nearly incessantly to avoid this, limiting the battery life of the devices, and when the batteries die the temperature of the materials increase very rapidly.

U.S. patent application Ser. No. 14/969,958 discloses a device that uses thermoelectric coolers to directly cool vials of medication using battery power. Unlike the present invention, it does not implement a cooling loop, or a vacuum flask in any way, which results in shorter battery life and therefore a faster increase in temperature inside the device, putting the materials at risk of spoiling.

U.S. patent application Ser. No. 12/777,256 discloses a vacuum flask device to maintain the temperature of vials of medication between 1 and 25 C. Unlike the present invention, there is no powered, active cooling, rather a bottle filled with a liquid at the proper temperature is inserted into the insulated volume along with the vials of medication. This means that the vials will remain in the proper temperature range only as long as the insulation allows. If the materials exceed this temperature range, the only way to cool the vials down again are to remove them from the device and use some other mechanism.

U.S. patent application Ser. No. 12/240,978 discloses a medicine cooler implementing the use of a shell with a grille and a door to give access to a cavity within the shell in which to store/cool medicine, a cooling and receiving structure coupled to a shell and including a TEC interposing a heatsink and a vial receiver, and an electronic cooling control and medicine efficacy indication circuitry coupled to the cooling and receiving structure. The device was designed to hold a single vial and pen and maintain them below 25 C, directed at short-term storage, as opposed to the long-term storage design of the present invention (U.S. patent application Ser. No. 12/240,978).

The present invention removes the risk of heat back-flow from a powered down cooler to the cooled volume, and in doing so increases the potential battery life of the device and removes the risk of the contents rapidly heating after the batteries die.

The disclosure itself, both as to its configuration and its mode of operation will be best understood, and additional objects and advantages thereof will become apparent, by the following detailed description of a preferred embodiment taken in conjunction with the accompanying drawing.

The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The accompanying drawings, which are incorporated herein, constitute part of the specifications, and illustrate the preferred embodiment of the invention.

DETAILED DESCRIPTION OF THE INVENTION

Figure 1:
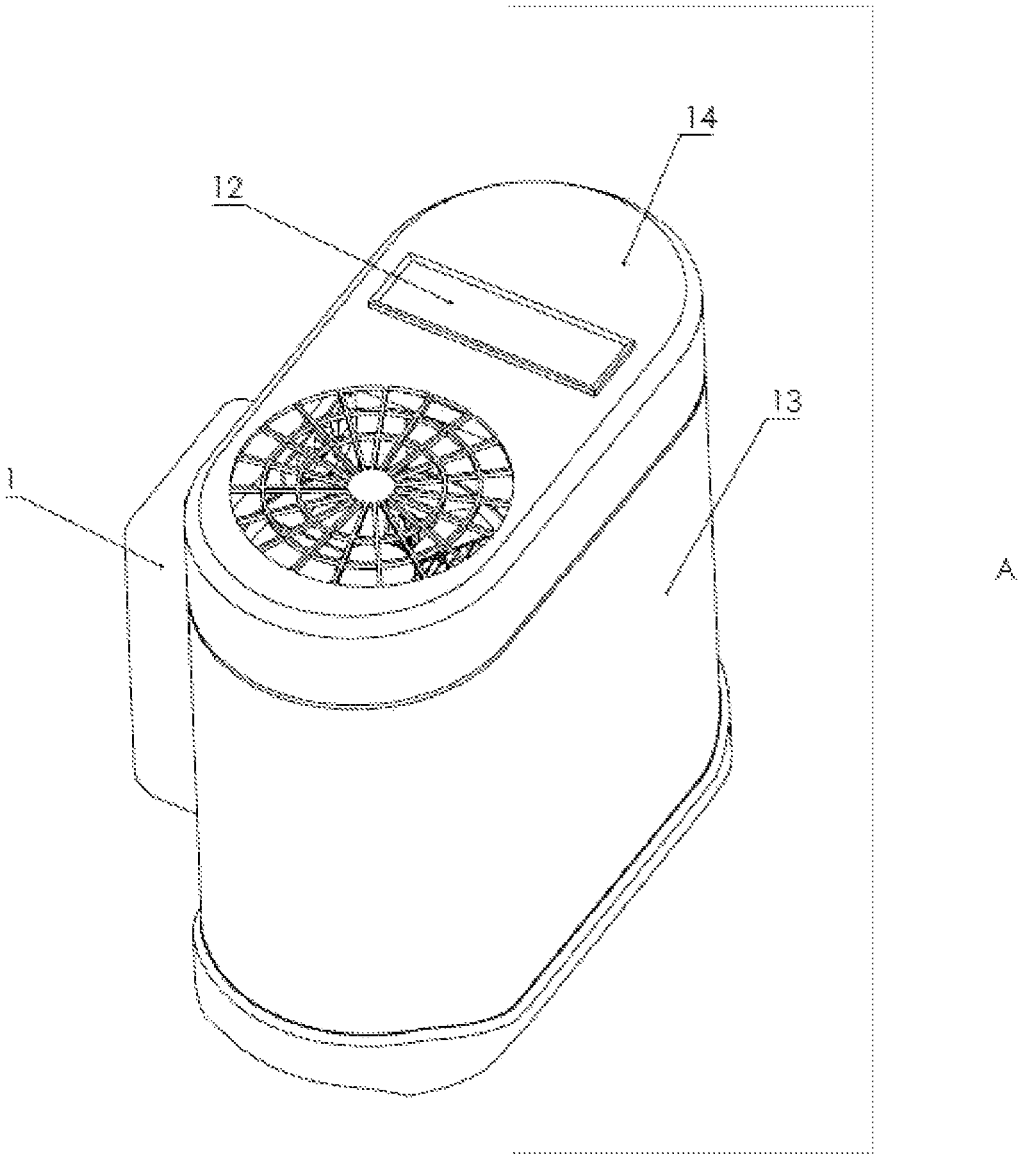
FIG. 1 shows an isometric view of an embodiment of the present invention.
Figures 2A, 2B:
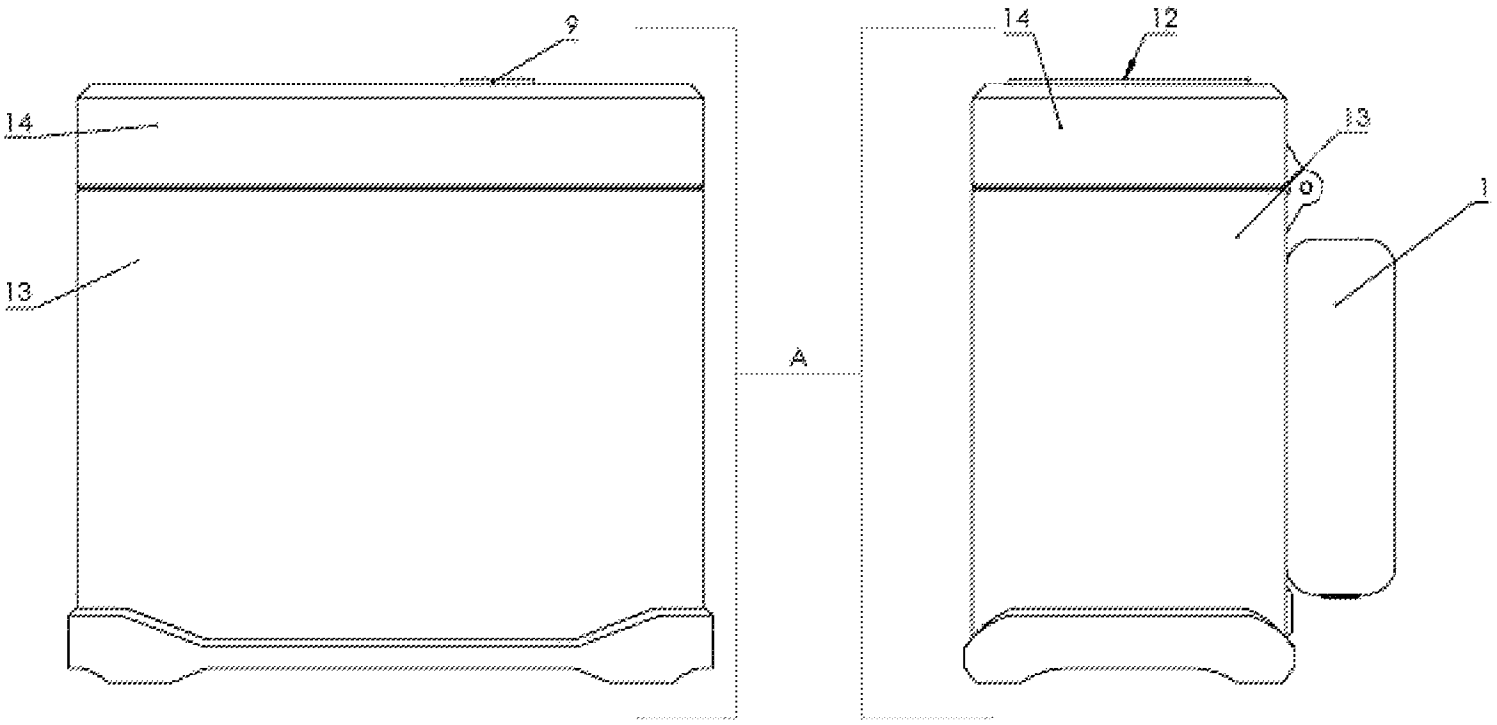
FIGS. 2A and 2B show a front and left side view of an embodiment of the present invention.
Figure 3A:
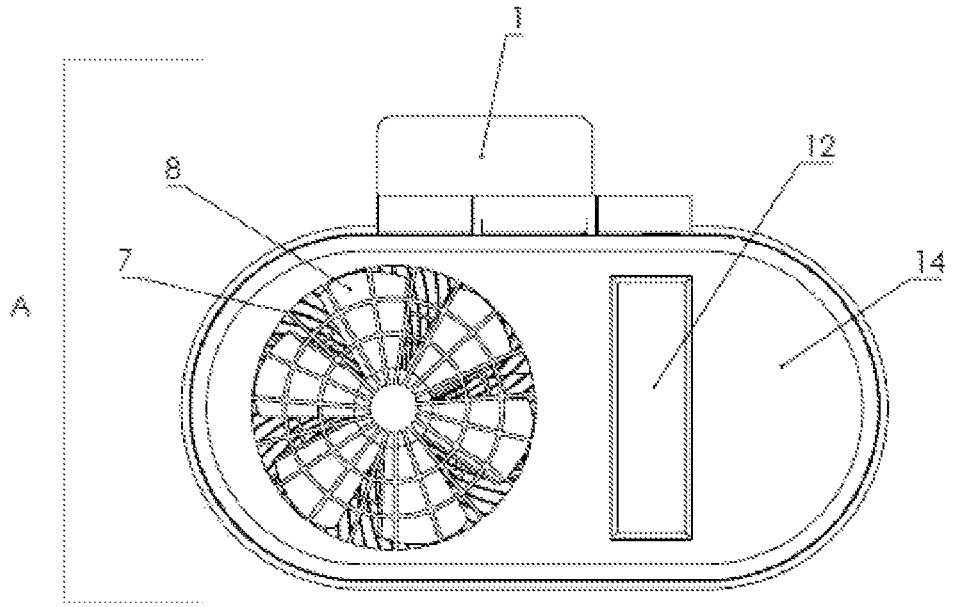
FIGS. 3A and 3B show a top and front side view of an embodiment of the present invention.
Figure 3B:
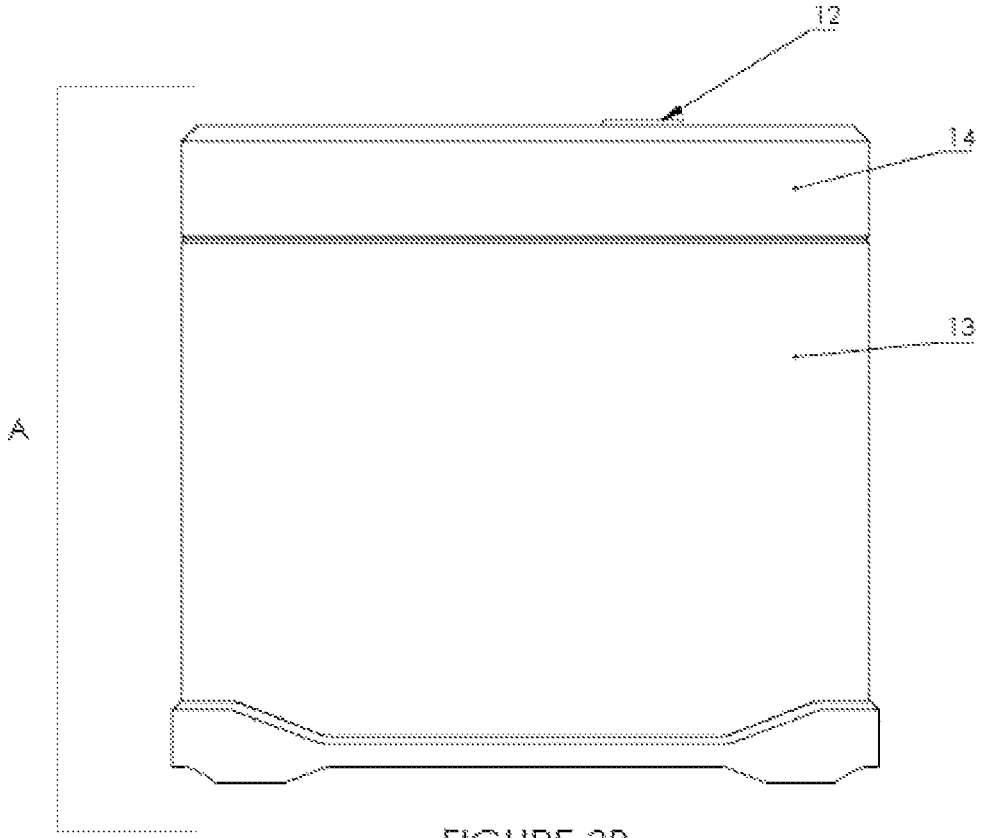

As stated above, the present invention relates to an insulation and cooling system or device A for storing temperature sensitive materials. Temperature-sensitive medications, bio-components, and many other expensive materials require cold storage, otherwise they risk degradation and spoilage. With current portable devices used to store these expensive materials, battery life is relatively short (4-8 hours) and when their batteries die, the latent heat within the cooling system heats the contents very quickly. This drastically increases the risk of spoiling. There is currently no small, portable cooling and storage solution with a long battery life to protect these materials. The invention claimed here solves this problem. The present invention implements a highly insulated volume and separates the thermal connection between the insulated volume and the cooler unit when powered down, increasing battery life and preventing heat back-flow to the contents.

The claimed invention differs from what currently exists. Previous means of storing temperature-sensitive medicines and bio-components in battery-powered devices have short battery life and risk the spoiling of the stored materials because the cooling units must be powered on nearly incessantly, otherwise the latent heat within the cooling unit flows to the stored materials. This invention solves this problem by implementing a highly-insulated volume in which to store the materials, and separating the cooling unit from said volume with a short cooling loop, reducing the run-time of the cooling unit and eliminating the latent heat from flowing to the materials when powered off.

Because of this heat flow to the cooled volume when the coolers are powered off, the current devices on the market have to run the coolers nearly incessantly, limiting the battery life of the devices, and when the batteries die, the contents of the devices very quickly heat up, risking spoiling.

As shown in FIGS. 4-10, the insulation and cooling system A comprises three lengths or segments of insulated tubing (9*a*, 9*b*, 9*c*), the first of which (9*a*) and second of which (9*b*) measure the same length. The first and second lengths 9*a*, 9*b*, which preferably measure 75 mm (but may also measure any length sufficient to connect their respective components), are run through the ports AP1 and AP2 respectively of the vacuum flask (2) (shown in FIG. 10A and FIG. 10B) and attached to the internal heat exchanger (3). The internal heat exchanger (3) is placed inside the vacuum flask (2). The first length of insulated tubing (9*a*) is attached to the first of the two ports (P1) of the water block (5) (or any similar type of heat exchanger to flow liquid through). The second length of insulated tubing (9*b*) is attached to the outlet (or the inlet) of the pump (4). The third length of insulated tubing (9*c*), which preferably measures 40 mm (but may also measure any length sufficient to connect the two components), is attached to the remaining port (P2) of the pump (4), with the other end of the tubing attached to the remaining port (P2) of the water block (5). Thermal paste (or some other kind of compound or medium used to promote heat transfer between two surfaces, though not required) (15) is spread on both of the two largest faces of the water block (5), and said faces are attached to the "cold side" of the Peltier coolers (6), so the water block (5) is sandwiched between the two Peltier coolers (6) with the "cold side" of the Peltier coolers (6) in contact with the water block (5). Thermal paste or some other kind of compound or medium used to promote heat transfer between two surfaces, though not required) (15) is spread on the "hot side" of the Peltier coolers (6) and those same sides of the Peltier coolers are attached to the appropriate face of the heat sinks (7). The fans (8) are attached to the opposite side of the heat sink (7) in a push (or pull, or push-pull) configuration.

Figure 4:
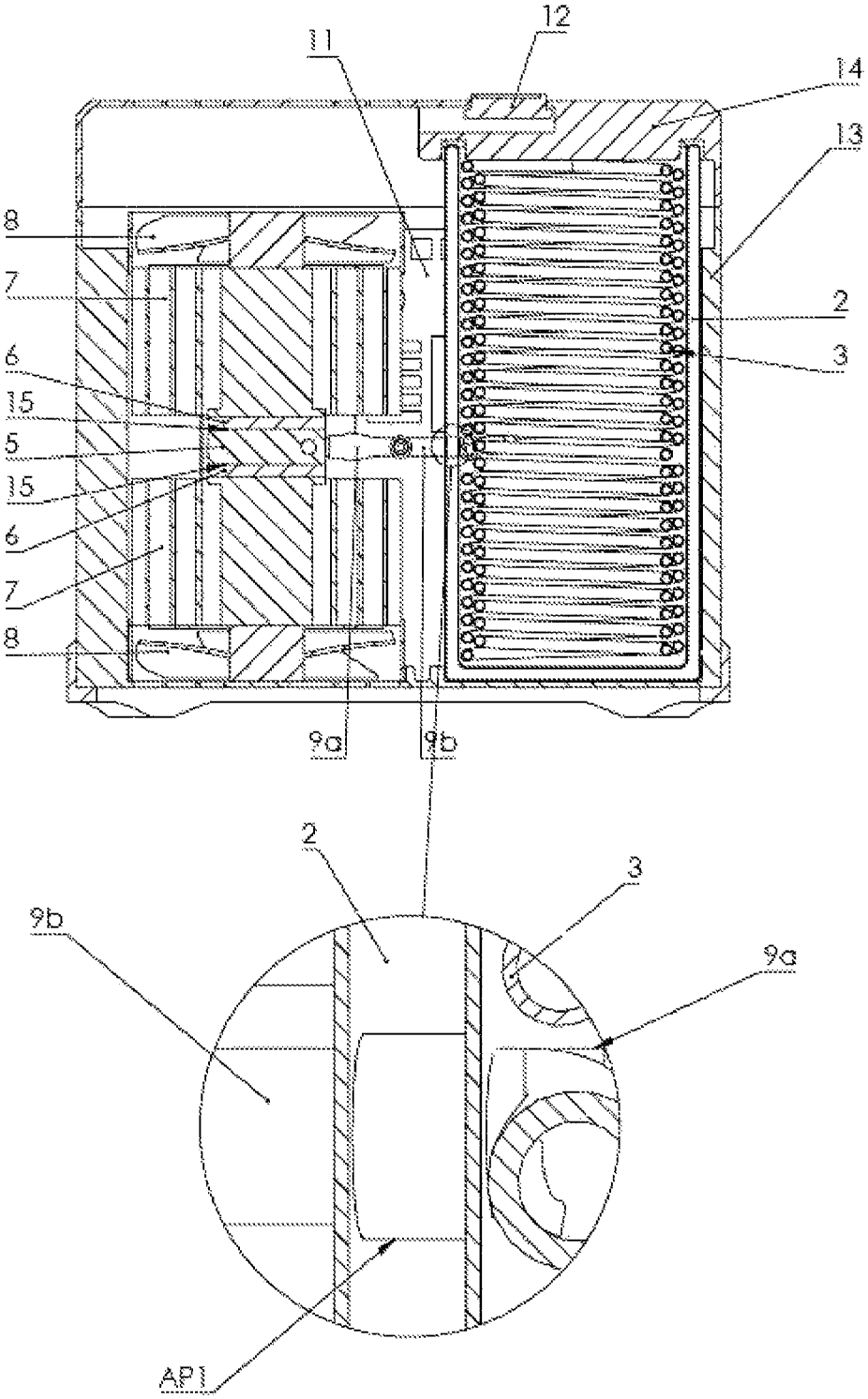
FIG. 4 shows a front cross-sectional view of an embodiment of the present invention.
Figure 5:
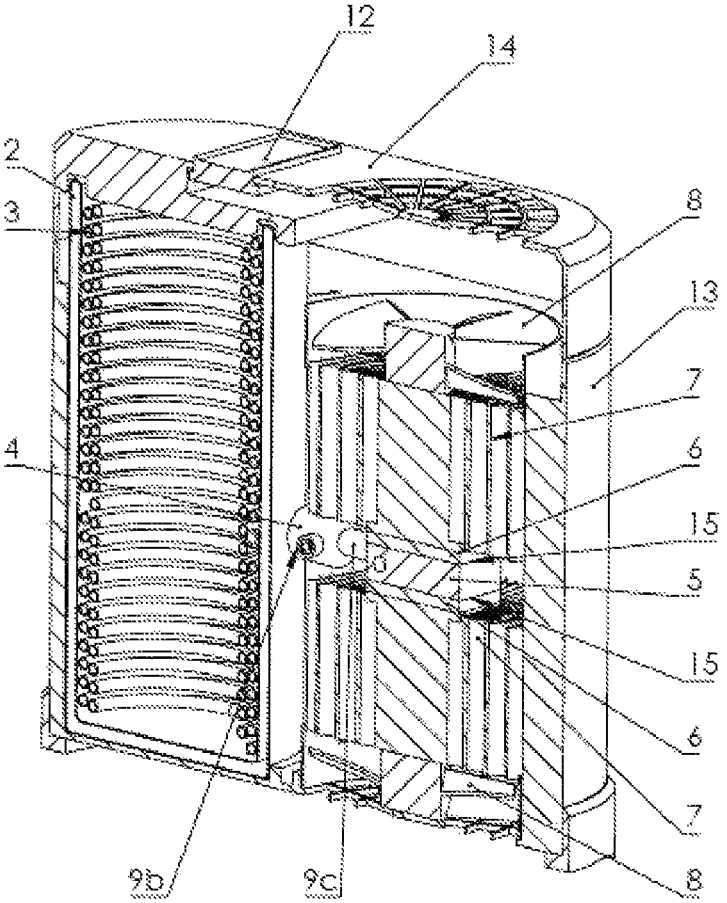
FIG. 5 shows an isometric cross-sectional view of an embodiment of the present invention.
Figure 6:
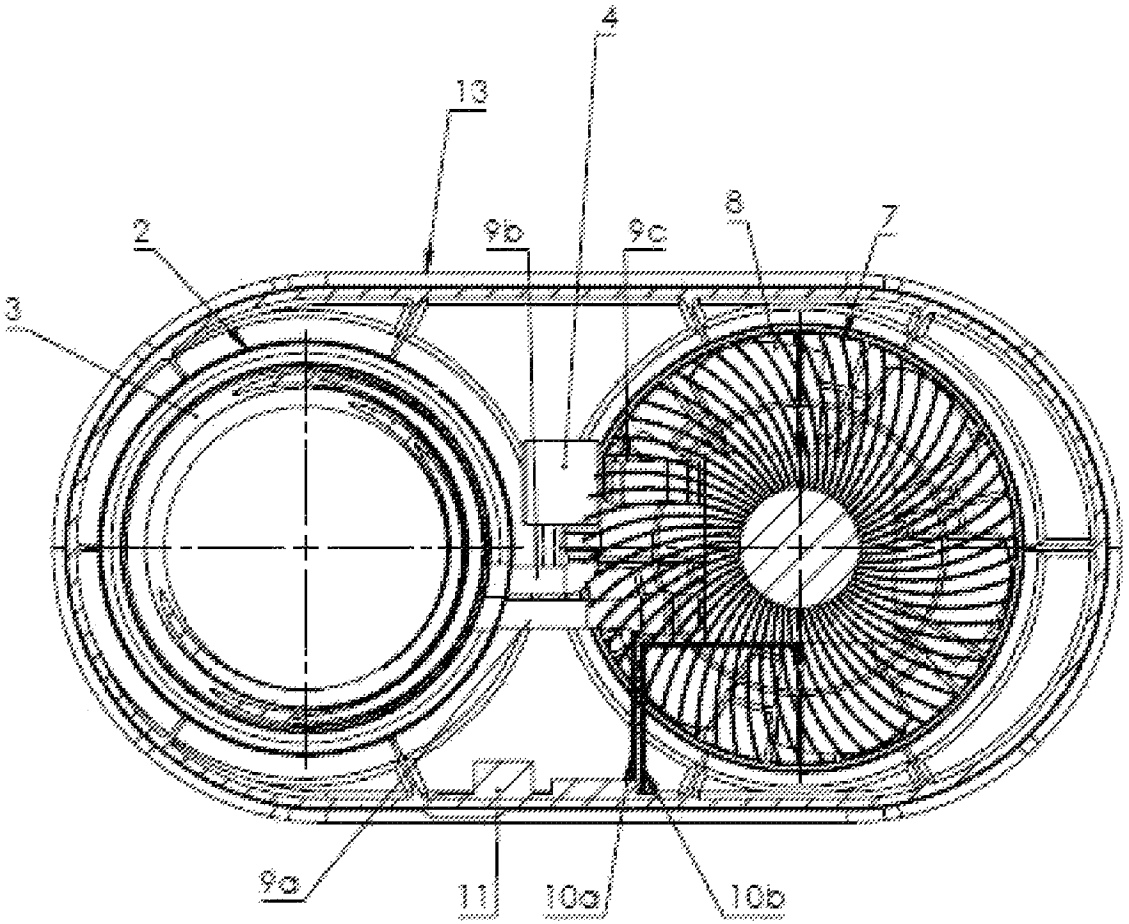
FIG. 6 shows a top down cross-sectional view at the mid-plane of an embodiment of the present invention

As shown in FIGS. 1-3B, the insulation and cooling system or device A comprises a screen (12) that is attached to the housing lid (14). Insulated copper wiring (not pictured) is used to connect the circuit board (11) to the Peltier coolers (6), the pump (4), the fan (8), the thermistors (10), and the battery pack (1). Moreover, the first thermistors (10*a*) (or other temperature sensor such as a thermocouple) is plugged into the circuit board and then inserted through a port of the vacuum flask (2) so the bulbs rest inside the vacuum flask volume. The second thermistor (10*b*) (or other temperature sensor such as a thermocouple) is attached to the circuit board, and then the bulb is attached to the water block. The entire assembly (fans (8), heat sinks (7), Peltier coolers (6), water block (5), pump (4), insulated tubing (9), vacuum flask (2), internal heat exchanger (3), thermistors (10), and the circuit board (11)) is placed inside the plastic housing (13) as shown in FIGS. 4-6. The plastic lid (14) is attached to the plastic housing at a hinge, as shown in FIGS. 2A and 2B.

The insulation and cooling system or device A measures the temperature of the thermistors inside the vacuum flask every few seconds. When the temperature is higher than 7 degrees Celsius (or whatever temperature is programmed by the user), the device powers on the Peltier coolers, fans. This cools the water block. Attached to this water block is a second thermistor, which reads the temperature of the water block every few seconds. Once the temperature of the water block reaches within the specified temperature range, the pump is powered on. This pumps liquid through the water block (cooling the liquid) and circulates the liquid into the vacuum flask to remove the heat from contents of the vacuum flask. When the temperature is measured to be below 4 degrees Celsius (or whatever temperature is programmed by the user) the device powers off the Peltier cooler and pump. This severs the thermal connection between the cooler and the cooled volume, leaning on the insulating properties of the vacuum flask (or similar highly-insulated volume) to maintain the temperature of the contents.

A highly-insulated lid for the vacuum flask would increase the insulation potential of the invention. Adding additional thermistors in other locations may improve the temperature monitoring and reporting. The fans (8) and heat sinks (7) could be replaced with another cooling solution, such as a radiator, pump and fan, or a passive cooling solution. The vacuum flask (2) could be replaced with another highly-insulating volume. The invention could function with only one Peltier cooler (6), heat sink (7), and fan (8). The fans (8), heat sinks (7), Peltier coolers (6), water block (5), and pump (4) could be interchanged with another cooling system, such as a standard vapor compression refrigeration system. The fans (8) and the heat sinks (7) could be replaced with another form of heat dissipation. The internal heat exchanger (3) could be replaced with a liquid reservoir, or other form of heat exchanger. The vacuum flask (2) could use one port, multiple ports, or no port. The vacuum flask (2) could have the port or ports in another location. Piping fixtures instead of port holes could improve the functionality of the vacuum flask.

Figure 7A:
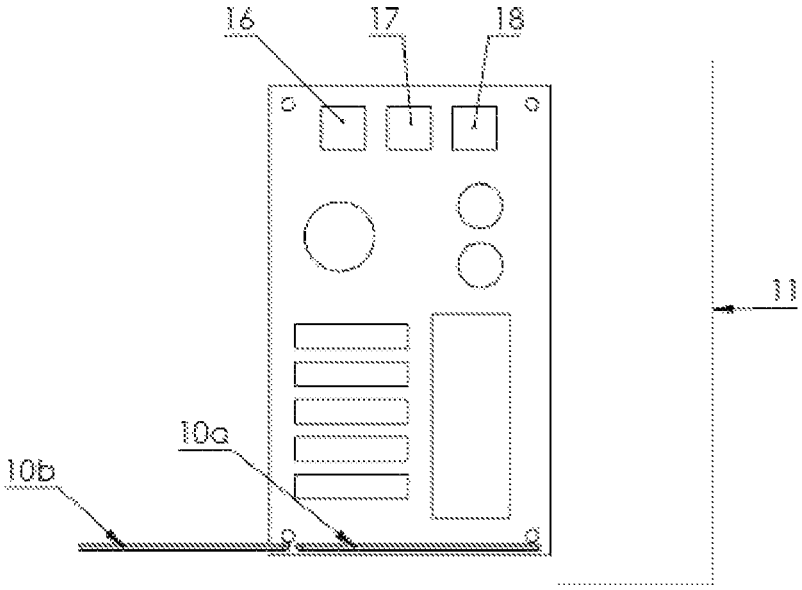
FIGS. 7A and 7B show a front and isometric view of a component within the embodiment of the present invention, specifically the circuit board.
Figure 7B:
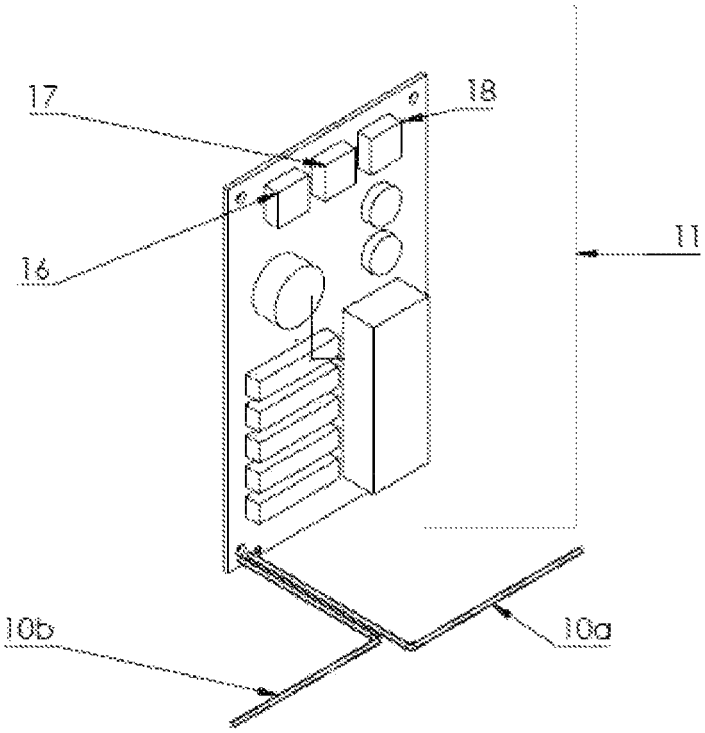
Figure 8A:
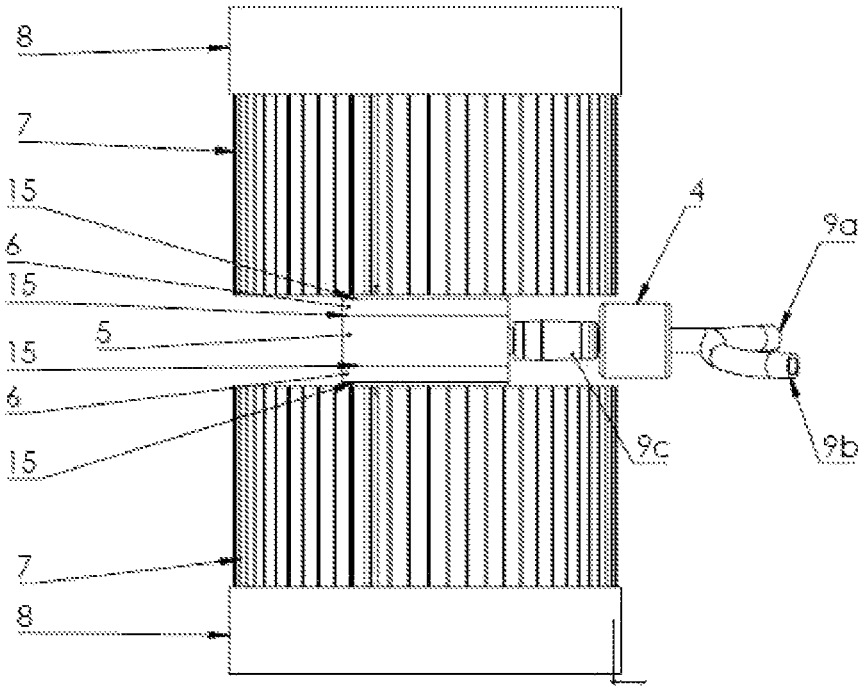
FIGS. 8A and 8B show a front and isometric view of an embodiment of the present invention, specifically the cooling assembly.
Figure 8B:
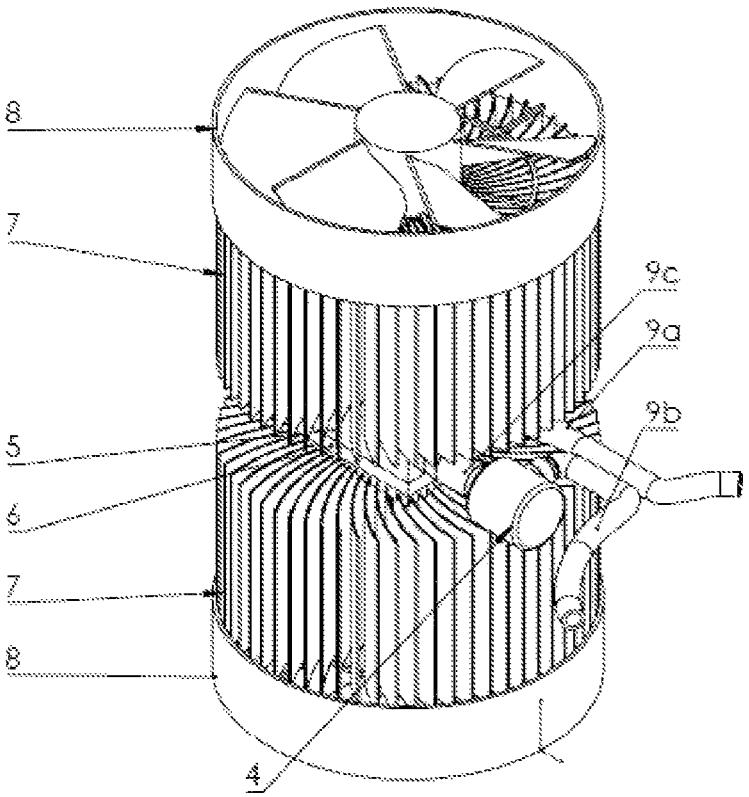
Figure 9A:
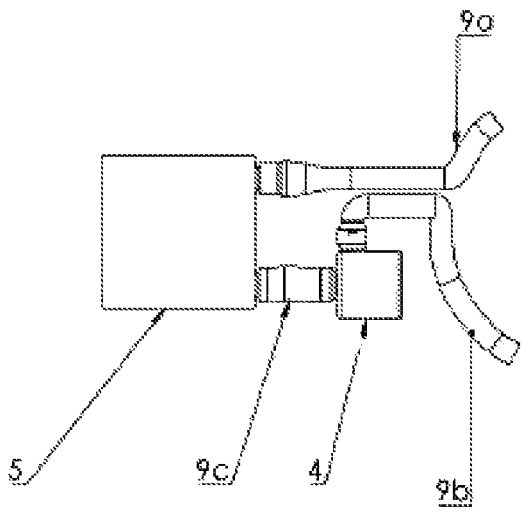
FIGS. 9A and 9B show a top view of an embodiment of the present invention, specifically the water block with and without the insulated tubing attached.
Figure 9B:
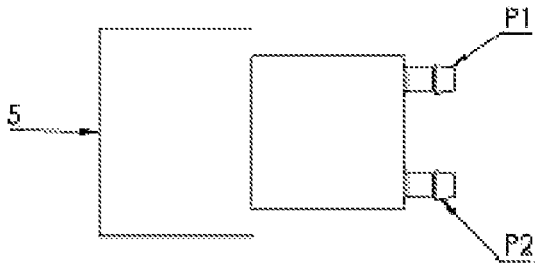
Figure 10B:
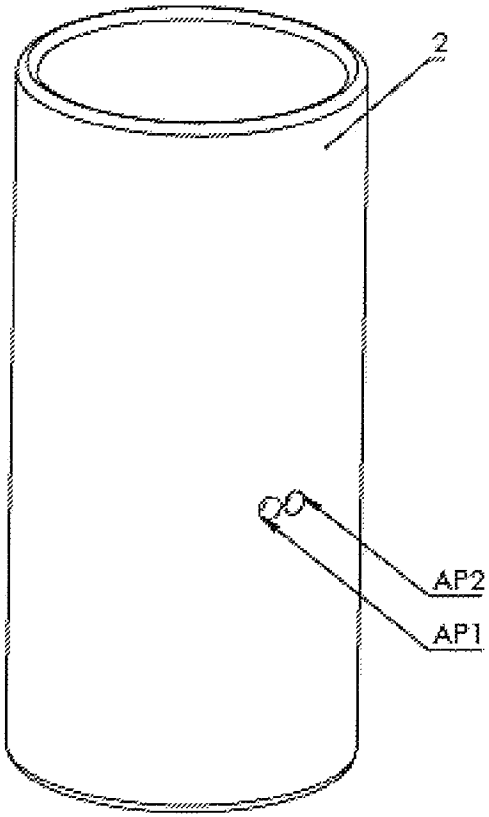
FIGS. 10A and 10B show a vacuum flask with additional ports, used in an embodiment of the present invention.
Figure 10A:
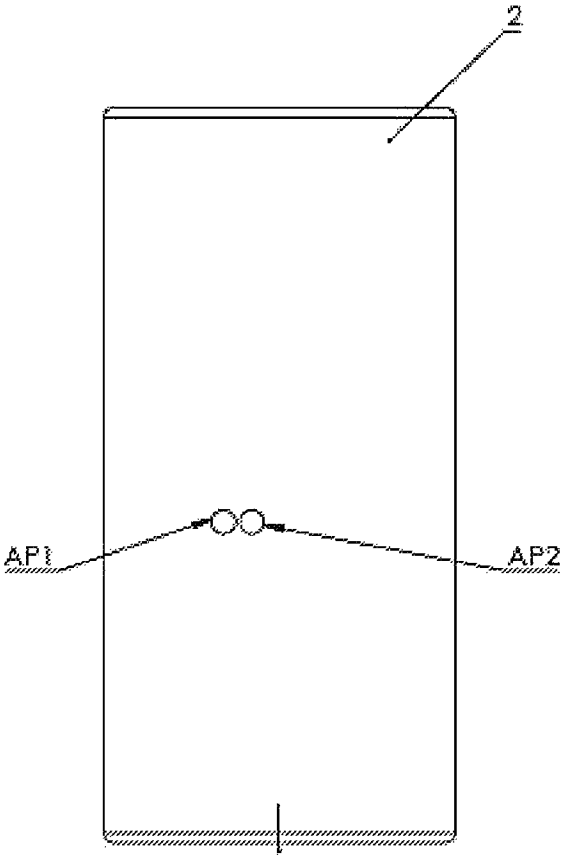
Figure 11:
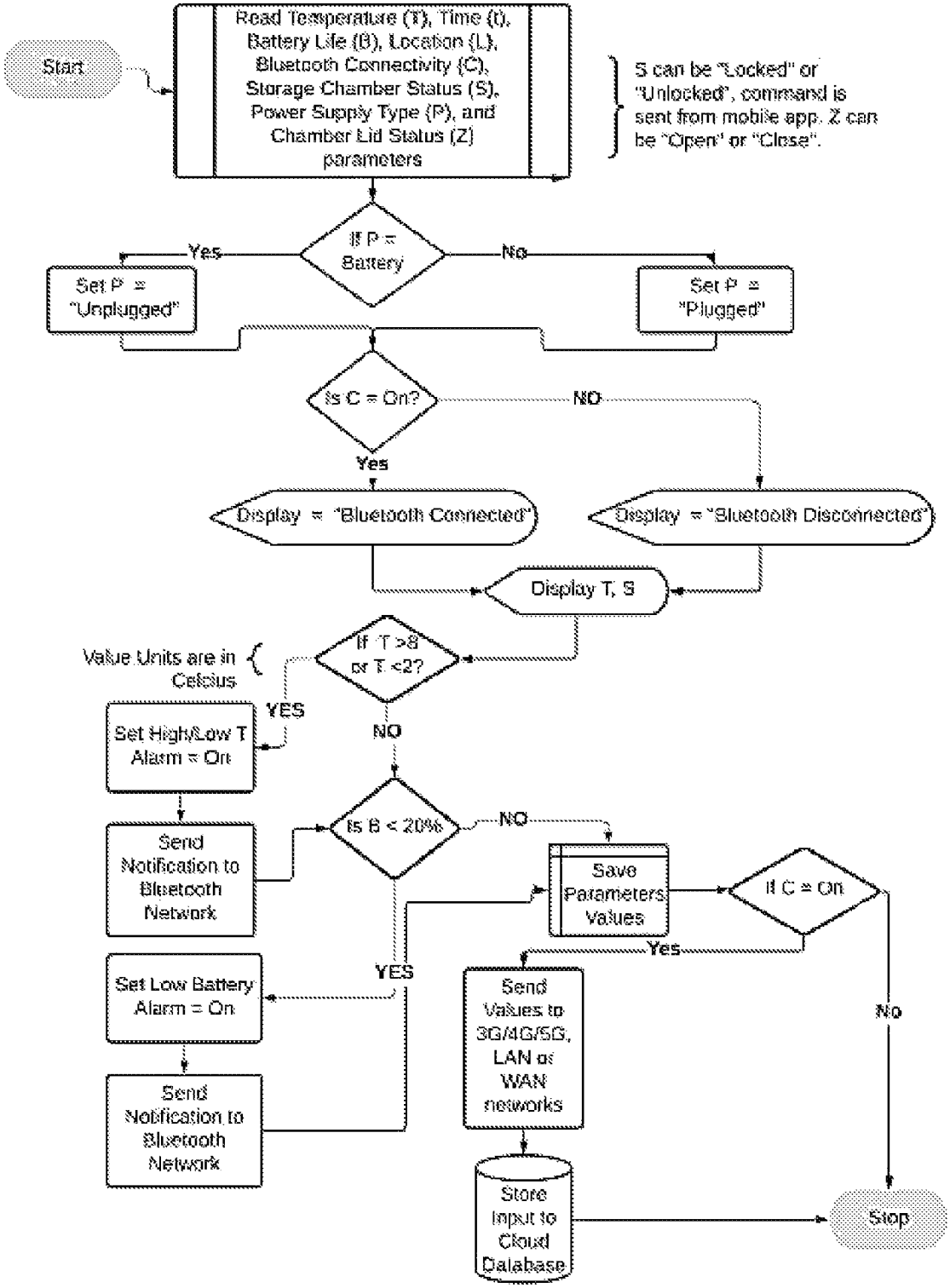
FIG. 11 shows a logic map of a monitoring and notification system for an embodiment of the present invention

As shown in FIG. 11, using the thermistors (10*a* and 10*b*) within the insulation and cooling system of Device A, real-time data collection could be achieved through 3G/4G/5G, LAN/WAN networks, or Bluetooth, using Bluetooth (16) and/or wifi (17) modules built into the circuit board (shown on FIG. 7). An internal database could be generated and stored using Cloud technology that communicates with the insulation and cooling system of Device A or with a mobile app that communicates with Device A through 3G/4G/5G, LAN/WAN networks, or Bluetooth and monitors several parameters such as Device performance, out of specification time, Device Temperature profile, Device Charging Cycles, Device Time used unplugged, Device Time off, Device time on, Device location. The data collected could inform the device integrated alarms and mobile app notifications to trigger if reached at a set threshold by the user or factory setting. Alarm notifications could include the following events: High and Low temperature, Low Battery life, Successful connection between the device and mobile app, lock and unlock device storage chamber, among others. This data could further enhance the user experience by providing detailed information on the device's performance, quality control, and safety.

The user would insert a battery pack (1), open the top of Device A, insert their temperature-sensitive materials into the vacuum flask, close the top, and power on the device. Additionally, the present invention could be used for the cooling, heating, and/or transportation of goods other than temperature-sensitive medications and bio-components. The size of the vacuum flask, the power of the cooling system, and the size of the battery pack (1) can be altered to fit different needs. If built large enough, the invention could serve as a refrigerator for all types of goods. If miniaturized, the device could cool and/or transport very smaller quantities of temperature sensitive goods.

Although certain exemplary embodiments and methods have been described in some detail, for clarity of understanding and by way of example, it will be apparent from the foregoing disclosure to those skilled in the art that variations, modifications, changes, and adaptations of such embodiments and methods may be made without departing from the true spirit and scope of the claims. Therefore, the above description should not be taken as limiting the scope of the invention.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means plus function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patently distinguish any amended claims from any applied prior art.

The invention claimed is:

1. An insulated cooling and heating system for storing temperature-sensitive materials, comprising:

a housing;

at least one battery;

a first segment of insulated tubing having a first end and a second end;

a second segment of insulated tubing having a first end and a second end;

a third segment of insulated tubing having a second end and a second end;

wherein the first segment of insulated tubing and the second segment of insulated tubing have the same length;

wherein the third segment of insulated tubing has a length that is lesser than the length of the first and second segments of insulated tubing;

a vacuum flask having a top end, a bottom end opposite the top end, and one or more sidewalls connecting the top end to the bottom end, wherein at least one of the sidewalls of the vacuum flask includes a first port and a second port;

wherein the vacuum flask further comprises an insulated volume adapted to store or receive temperature-sensitive materials within the vacuum flask;

wherein the insulated volume of the vacuum flask is surrounded by one or more walls or layers comprising a vacuum space;

a heat exchanger;

wherein the heat exchanger is located inside the vacuum flask;

a first heat sink and a second heat sink;

a first fan and a second fan;

a first thermoelectric (Peltier) cooler and a second thermoelectric (Peltier) cooler, wherein each of the first and second thermoelectric (Peltier) coolers comprises a cold side and a hot side;

a first thermistor and a second thermistor;

a circuit board;

a pump comprising an inlet and an outlet;

a water block comprising a first face, a second face opposite the first face, and a plurality of side walls connecting the first face to the second face;

wherein at least one of the sidewalls of the water block includes a first port and a second port;

wherein the first end of the first segment of insulated tubing is attached to the first port of the water block and the second end of the first segment of insulated tubing is attached to the heat exchanger via the first port of the vacuum flask;

wherein the first end of the second segment of insulated tubing is attached to the outlet of the pump and the second end of the second segment of insulated tubing is attached to the heat exchanger via the second port of the vacuum flask;

wherein the first end of the third segment of insulated tubing is attached to the second port of the water block and the second end of the third segment of insulated tubing is attached to the inlet of the pump;

wherein the first face of water block is attached to the cold side of first thermoelectric (Peltier) cooler, and the second face of the water block is attached to the cold side of the second thermoelectric (Peltier) cooler, such that the water block is flanked by the cold side of the first thermoelectric (Peltier) cooler and the cold side of second thermoelectric (Peltier) cooler;

wherein the hot side of the first thermoelectric (Peltier) cooler is attached to the first heat sink;

wherein the hot side of the second thermoelectric (Peltier) cooler is attached to the second heat sink;

wherein the first heat sink is attached to the first fan;

wherein the second heat sink is attached to the second fan;

wherein the first thermistor is attached to the heat exchanger via at least one of the first port or the second port of the vacuum flask;

wherein the second thermistor is attached to the water block; and wherein the circuit board, the first and second Peltier coolers, the pump, the first and second fans, the first and second of thermistors, the first and second heat sinks, and the at least one battery are all connected and located inside the housing.

2. The insulated cooling system of claim 1, where said circuit board, the first and second Peltier coolers, said pump, the first and second of fans, the first and second of thermistors, and said at least one battery are all connected using an insulated copper wiring.

3. The insulated cooling system of claim 1, further comprising a programmable screen.

4. The insulated cooling system of claim 1, further comprising thermal paste spread between the first and second Peltier coolers and the first and second of heat sinks.

5. The insulated cooling system of claim 1, further comprising thermal paste spread between the first and second Peltier coolers and said water block.

6. The insulated cooling system of claim 1, comprising a radiator or other heat-dissipation mechanism.

7. The insulated cooling system of claim 1, comprising a liquid reservoir instead of the heat exchanger.

8. The insulated cooling system of claim 1, further comprising a data collection and sharing system for performance and temperature monitoring.

9. The insulated cooling system of claim 1, wherein the first and second segment of insulated tubing measure 75 mm.

10. The insulated cooling system of claim 1, wherein the third segment of insulated tubing measures 45 mm.

11. The insulated cooling system of claim 1, wherein the housing comprises a hinge and a plurality of holes.

* * * * *